United States Patent [19]

Huggins et al.

[11] Patent Number: 4,638,986

[45] Date of Patent: Jan. 27, 1987

[54] FEEDABILITY SENSOR FOR A VACUUM CORRUGATED FEEDER

[75] Inventors: Raymond W. Huggins, Pittsford; Ralph A. Shoemaker, Rochester, both of N.Y.

[73] Assignee: Xerox Corporation, Stamford, Conn.

[21] Appl. No.: 667,693

[22] Filed: Nov. 2, 1984

[51] Int. Cl.[4] ..... B65H 3/12

[52] U.S. Cl. ..... 271/98; 271/35; 271/108; 271/146

[58] Field of Search ..... 271/94, 96, 98, 99, 271/108, 35, 146

[56] References Cited

U.S. PATENT DOCUMENTS

| | | | |
|---|---|---|---|
| 3,595,563 | 7/1971 | Rostoker | 271/98 X |
| 3,598,399 | 8/1971 | Cottrell | 271/146 |
| 4,269,406 | 5/1981 | Hamlin | 271/108 |
| 4,270,746 | 6/1981 | Hamlin | 271/98 |
| 4,284,270 | 8/1981 | Silverberg | 271/166 |
| 4,336,928 | 6/1982 | Smith et al. | 271/3.1 |
| 4,336,929 | 6/1982 | Hanzlik | 271/20 |

*Primary Examiner*—Richard A. Schacher

*Attorney, Agent, or Firm*—Ronald F. Chapuran

[57] ABSTRACT

A system for measuring the friction between the bottom two sheets of the stack. The bottom-most sheet is held to a vacuum corrugation feeder tray by any suitable means such as a vacuum and moves with the tray. The vacuum corrugation feeder tray is mounted on compliant supports and driven near or at its resonant frequency by an electromechanical driver. At low or zero air knife pressure, the paper stack is mechanically coupled to the tray and moves with the tray, possibly slipping at some point during the vibration cycle. As the air knife pressure increases, the mechanical coupling decreases, and a point is reached at which the stack remains stationary. Prior to the point where stack motion ceases, the resonance of the tray is modified and it is possible to estimate the weight of the stack. When the stack motion ceases, the frictional force F can be estimated from the driving force required to maintain a given vibrational amplitude. From the driving force required to maintain a given vibrational amplitude and the mass of the tray or stack, it is possible to calculate the coefficient of friction between the bottom two sheets. The coefficient of friction is then used to control the amount of air pressure from the air knife until an optimum coefficient of friction is achieved.

18 Claims, 7 Drawing Figures

PERIODIC FORCE ON BACKSTOP

MOTION OF STACK WITH COMPLIANT BACKSTOP

FEEDABILITY SENSOR FOR A VACUUM CORRUGATED FEEDER

This invention relates to document and sheet feeders and, in particular, to a sensor for a vacuum corrugation feeder using a vibrating tray.

In the use of high speed xerographic reproduction machines, there is a need for document handlers and sheet feeders to feed documents and sheets in a rapid dependable manner. The document and sheet feeders must operate flawlessly to eliminate the risk of damaging the documents and sheets and to minimize machine shutdowns due to uncorrectable misfeeds or document multifeeds. Of prime concern is the initial separation of the individual documents or sheets from the sheet or document stack.

In a document handler, the documents must be suitably handled to insure separation without damage through a number of cycles. Suggested separators have included friction rolls or belts used for positive document feeding in conjuncton with a retard belt, pad or roll to prevent multifeeds. Vacuum separators such as sniffer tubes, rocker type vacuum rolls, or vacuum feed belts have also been used.

While the friction roll-retard systems are very positive, the action of the retard member, if it acts upon the printed face of a document can cause smearing or partial erasure of the printed material. The problem is very difficult to control with two-sided documents. In addition, the reliable operation of friction retard feeders is highly dependent on the relative frictional properties of the paper being handled.

In document handlers where the document set may be circulated many times, the document handler is normally provided with a bottom sheet separator-feeder to allow feeding of documents while documents which have already been copied are returned to the top of the document stack. In this way, after all the documents have been copied they are in correct order to recirculate if necessary.

One of the major problems with bottom sheet feeders is that without knowing how large a stack of documents is to be placed in the feed tray or the paper weight of the individual documents, it is difficult to design a sheet separator that is gentle enough for small stacks or light weight paper and still capable of handling large stacks or heavy weight paper.

Attempts to overcome this problem include U.S. Pat. No. 4,269,406 disclosing a vacuum corrugating feeder wherein the design of the document tray, the orientation of the vacuum separator belts, the design and orientation of the air knife, the use of a single blower to provide subatmospheric and atmospheric air pressure for the vacuum separator belts and the air knife, and the air flow control valve all combine to provide a sheet separator that is relatively insensitive to the variation in document stack size or paper weight. However, it has been found that with extremely stiff documents, the document may not be held on the feed belt securely enough to insure consistent document feed, thereby resulting in the possibility of a misfeed.

To overcome this problem, U.S. Pat. No. 4,336,929 teaches a sheet feeder for separating and feeding the bottom sheet in a stack including a plurality of vacuum feed belts spaced from the bottom surface of the document stack. Corrugating means associated with the vacuum feed belts are adapted to hold the sheet acquired by the vacuum feed belts in a non-planar condition to provide a corrugation in the acquired sheet. The corrugating means are biased in an upward direction such that light weight sheets have insufficient beam strength to deflect the corrugating means in a downward direction, thereby providing maximum corrugation in the sheet while heavy weight sheets are adapted to force the corrugating means downward, thereby providing less corrugation to the sheet while at the same time allowing the sheet to more closely approach the vacuum openings in the vacuum feed belts for adequate aquisition of the sheet.

Other attempts to solve the problems associated with bottom of the stack sheet feeders are taught in U.S. Pat. Nos. 4,270,746 and 4,284,270. U.S. Pat. No. 4,284,270 teaches a plurality of vacuum feed belts spaced from the bottom surface of the document stack, the sheet stack being supported on a stack tray having a "U" shaped pocket form therein. The vacuum from the feed belts causes a portion of the bottom sheet in the stack to be pulled into the pocket for contact with the vacuum belts. U.S. Pat. No. 4,270,746 teaches the use of an air knife to produce a plurality of air streams directed downwardly toward the lead edge of the bottom sheet. The knife is located relative to the lead edge of the sheet stack and a vacuum feeder belt assembly to provide optimum performance irrespective of curl encountered in the sheets being fed.

A general problem with bottom feed document handlers is the providing of the correct air flow from an air knife to compensate for various paper thicknesses or stiffness. With a very small stack of documents, excessive air flow will cause excessive document flutter or, in the extreme, actually blow documents out of the document tray. With a large stack of documents, insufficient air will neither produce the required air pressure nor separation between the sheet resulting in misfeeds or multifeeds. One method of compensating for this difficulty is shown in U.S. Pat. No. 4,336,928. In particular, the number of documents in the document stack during the first circulation is counted. If the number of documents in the stack is above a preselected number, an increased amount of air is supplied to the air knife. U.S. Pat. No. 4,269,406 discloses a means to automatically compensate for variable weight sheets.

It is also known to control air knife pressure by measuring the height of the document stack. An initial air knife pressure setting was determined by the height of the stack followed by a reduction during feeding at a predetermined rate based on copy count. Other attempts to control the air knife pressure used a sensor to measure the air pressure in an air pocket underneath the stack.

A difficulty with the prior art attempts at vacuum corrugation feeding was that the reliable operation of the feeder generally depends upon the optimization of the air knife pressure. If the pressure is too low, the area of the air bearing formed between the bottom and next to bottom sheets will be less than the area of the sheet, and a considerable contact area between the sheets will exist. If an attempt is made to feed the bottom sheet, then possibly the next to bottom sheet and maybe many more sheets would be dragged out by the bottom sheet, resulting in a misfeed. Also, prior systems usually have difficulty in handling stressed paper, that is paper that is buckled or curled where it is difficult to establish an air pocket. On the other hand, if the air pressure is too high, excessive flutter of the sheets will occur, and if the stack comprises only a few sheets, these sheets may be blown away. The optimum air knife pressure for a one inch stack of paper will obviously be much greater than that for only a few sheets. It follows that after the initial optimization of the air knife pressure, the pressure must be reduced as a stack of paper is fed.

It is, therefore, an object of the present invention to provide a reliable means to control the air knife pressure in a vacuum corrugation feeder. It is another object of the present invention to provide a simple and economical means to operate a vacuum corrugation feeder.

Briefly, the present invention is a system for measuring the coefficient of friction between the bottom two sheets of the stack provided that the coefficient of friction between sheets 1 and 2 can be measured. If the coefficient of friction can be measured, the condition for feeding is that the coefficient of friction is less than the tangent of the tray angle with respect to the horizontal. The vacuum corrugation feeder tray and vacuum plenum assembly is mounted on compliant supports and driven near or at its resonant frequency by an electromechanical driver. Sheet 1 is held tightly to the tray by the vacuum plenum. At low or zero air knife pressure, the paper stack is mechanically coupled to the tray through sheet 1 and moves with the tray, possibly slipping at some point during the vibration cycle. As the air knife pressure increases, the mechanical coupling between sheet 1 and sheet 2 decreases, and the point reached at which the stack except for sheet 1 remains stationary. Prior to the point where stack motion ceases, the resonance of the tray is modified and it is possible to estimate the weight of the stack. When the stack motion ceases, the frictional force F between sheet 1 and sheet 2 can be estimated from the driving force required to maintain a given vibrational amplitude. From the driving force required to maintain a given vibrational amplitude and the mass of the tray or stack, it is possible to calculate the coefficient of friction between the bottom two sheets. The coefficient of friction is then used to control the level of the air pressure from the air knife until an optimum coefficient of friction is achieved.

Other objects and advantages of the present invention will become apparent upon reading the following detailed description and upon reference to the drawings wherein the same reference numerals have been applied to like parts and wherein.

Figure 1:
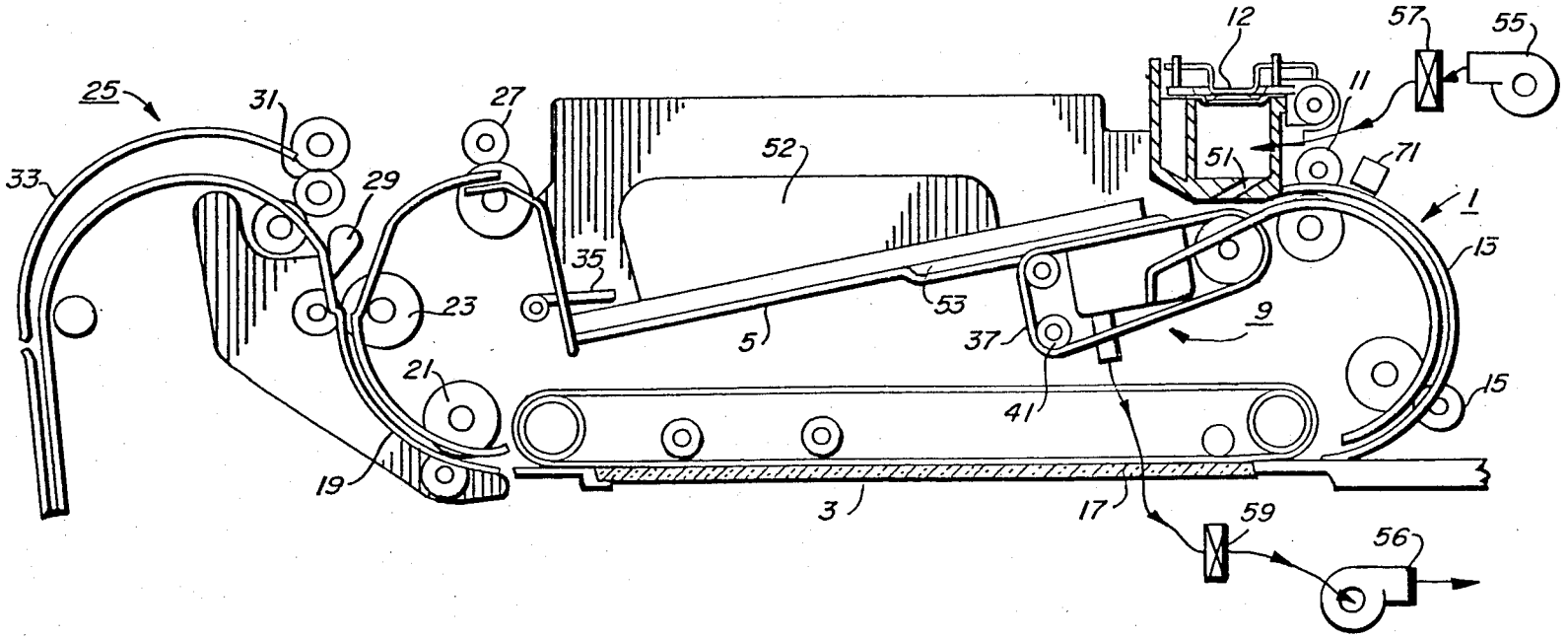
FIG. 1 is a cross-sectional view of an exemplary document handler for practicing the method of the present invention.

Referring to the drawings, there is illustrated an automatic document handler 1 for installation above the exposure platen 3 of a xerographic reproduction machine. The document handler is provided with a document tray 5 adapted for supporting a stack of documents 7. A vacuum belt corrugating feeder mechanism 9 is located below the document tray for acquiring and corrugating the bottom document in the stack and forwarding the document to take away roll pair 11 after an air knife 12 has had time to elevate the rest of the stack from sheet 1. The document is then fed by take-away roll pair 11 through document guide 13 to feed roll pair 15 and under platen belt 17 onto the platen of the copy machine for reproduction.

After exposure of the document, it is fed off the platen by belt 17 into guide 19 and feed roll pairs 21 and 23 either to an inverter mechanism 25 or back to the document stack through the feed roll pair 27. A divertor 29 is provided to divert the document either to the inverter or to the feed roll pair 27. The inverter comprises a three roll arrangement 31 and a closed inverter pocket 33.

Figure 2:
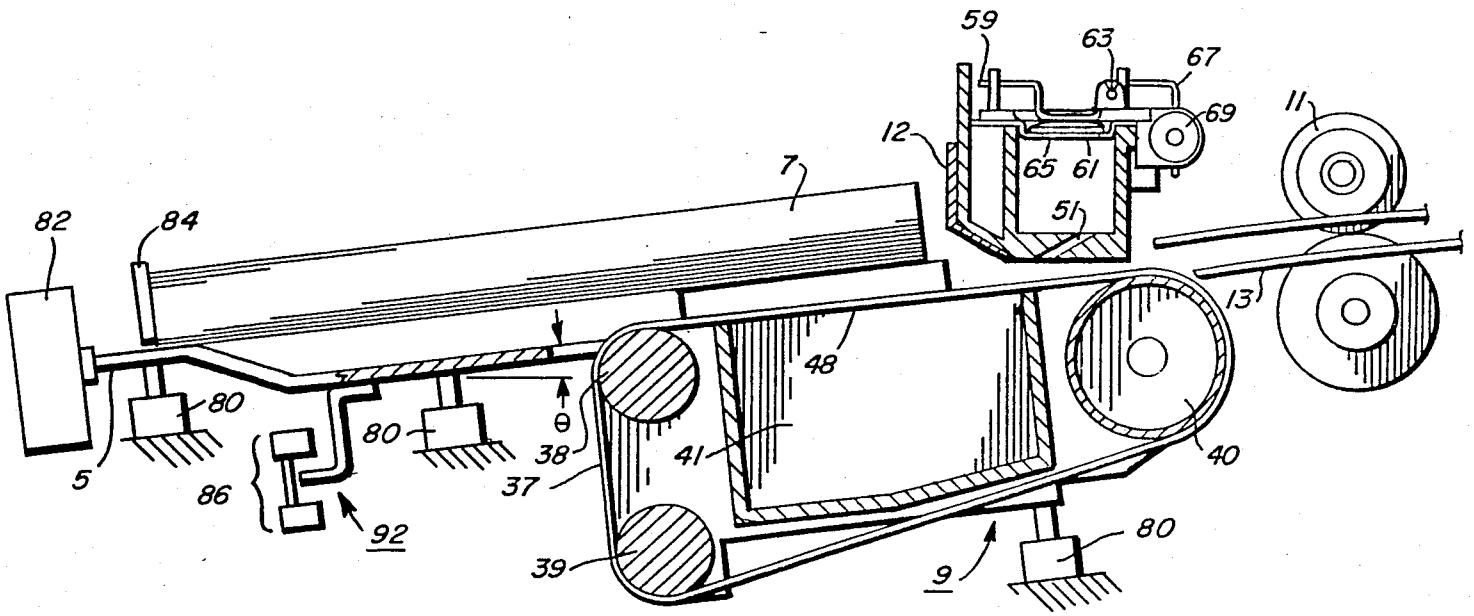
FIG. 2 is an enlarged, cross-sectional view of the separator-feeder portion of the document handler of FIG. 1.
Figure 3:
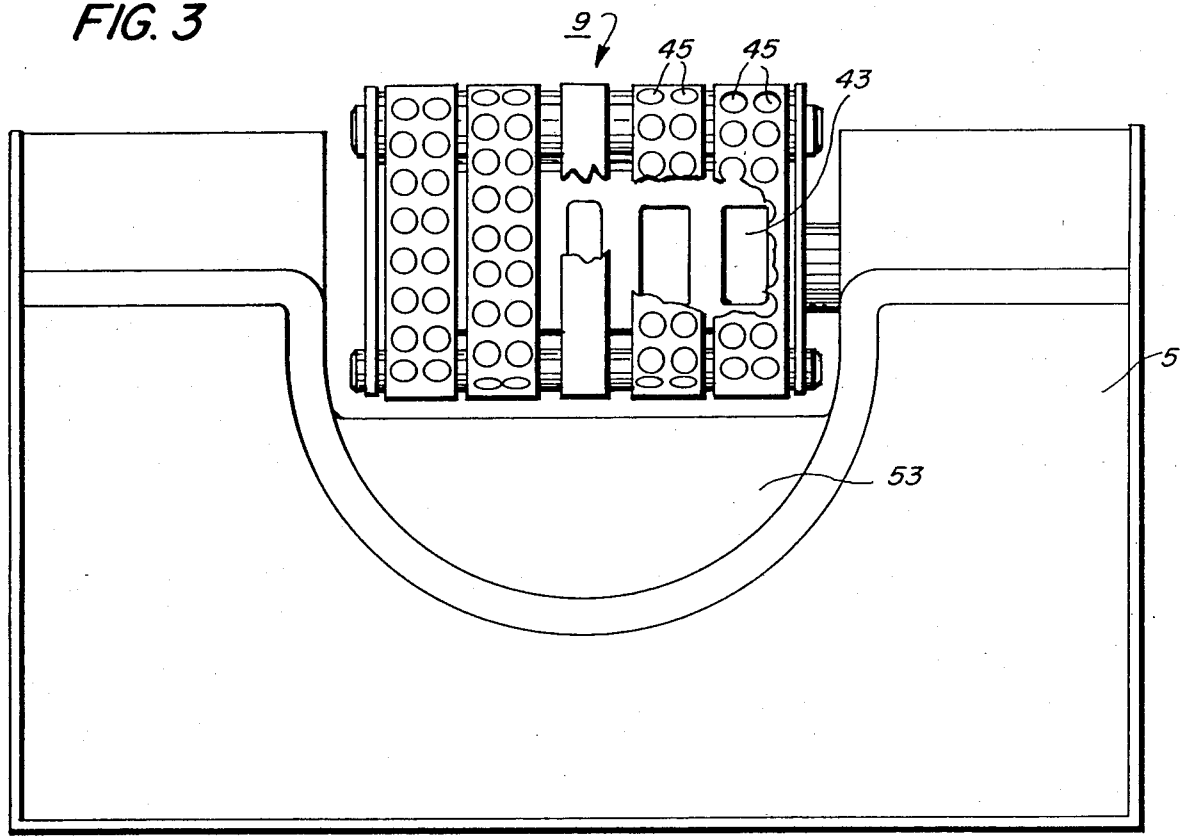
FIG. 3 is a top view of the document tray and feed belts of the document handler illustrated in FIG. 1.

Referring more particularly to FIGS. 2 and 3 wherein the document separator feeder is more clearly illustrated, there is disclosed a plurality of feed belts 37 supported for movement of feed belt rolls 38, 39 and 40. Spaced within the run of the belts 37 there is provided a vacuum plenum 41 having openings 43 therein adapted for cooperation with perforations 45 in the belts 37 to provide a vacuum for pulling the bottom document in the document stack onto the belts 37. As can be seen from FIG. 2, the belts are below the surrounding support surfaces. Thus, the document is corrugated thereby. In the unlikely event that more than one document is pulled down into contact with the feed belts, the beam strength of the second document resists the corrugating action, thus gaps are opened between sheets 1 and 2 which extend their lead edges. These gaps and channels reduce the vacuum levels between sheets one and two due to porosity in sheet one and provide for entry of the separating air flow from the air knife 12. The air knife 12 comprising a pressurized air plenum having a plurality of air jet openings 51 is provided to inject air into the pocket formed between the document pulled down against the feed belt and the documents thereabove to provide an air cushion or bearing between the stack and the bottom document to minimize the force necessary for removing the bottom document from the stack. It can be understood that if two documents are pulled down toward the belts 37, since the top sheet would not be corrugated, the air knife would inject air into the space between the two documents and force the second document off from the raised belt back toward the document stack.

By reference to FIGS. 1, 2 and 3 it can be seen that the document tray 5 is provided with a depressed portion or pocket 53 behind the feed belt assembly. This pocket serves a number of purposes. First, space is provided for the forward portion of the bottom document to be pulled down onto the feed belt assembly. When the bottom document is pulled into this space and corrugated, an envelope type opening or pocket is created between the bottom sheet and the remainder of the sheets in the stack. Air injected into this space from the air knife produces an air bearing between the bottom sheet and the remainder of the stack to allow removal of the bottom sheet from beneath the stack. Flow of air from the pocket is restricted by the partial seal or flow restriction caused by supporting the major portion of the stack weight on the edge portions of the tray surrounding the pocket.

With reference to FIG. 1, it can be seen that blower unit 55 is used to provide pressurized air to air knife 12.

A valve 57 is provided in the inlet line to blower 55. A second blower 56 with valve 59 creates a vacuum to pull down the bottom sheet onto vacuum plenum 41. The tray 5 and the vacuum plenum assembly are mounted on compliant supports or springs illustrated at 80 and driven at resonant frequency by an electromechanical driver 82. Sheet 1 is held against the tray and at zero air knife pressure, the paper stack is mechanically coupled to the tray 5 through sheet 1 and moves with the tray. As the air knife pressure increases, the mechanical coupling decreases. A point is reached where the stack remains stationary although frictional damping still occurs.

Prior to the point where stack motion ceases, the resonance of the tray 5 and vacuum plenum 41 assembly is modified. In principal, it is possible to estimate the weight M of the stack. When the stack motion ceases, the frictional force F can be estimated from the driving force required to maintain a given vibrational amplitude. From these two parameters, M and F, it is possible to calculate the coefficient of friction. In response to the coefficient of friction, the air knife pressure can be increased until the point is reached that the coefficient of friction between the bottom two most sheets of the stack is below a predetermined value.

In one embodiment, paper is placed on the tray 5 resting against fixed backstops illustrated at 84 in FIG. 2, the tray being mounted on the E springs 80 and driven by the driver 82, preferably a suitable voice coil. The paper stack will be stationary if the air knife pressures are high enough to insure that the frictional force never exceeds the component of gravity holding the stack of paper against the back stops on the inclined paper tray during the oscillation cycle.

The differential equation which describes forced simple harmonic motion of the paper tray with both Coulomb (frictional) and viscous damping is $$M\ddot{x}+kx\pm F+c\dot{x}=P\cos(\omega t+\phi) \quad (1)$$

where:

M=mass of the tray and vacuum plenum assembly,
k=spring constant,
F=frictional force,
c=viscous damping coefficient, and
P=amplitude of the driving force.

F arises from either paper-to-tray or paper-to-paper friction and equals $M_p g u_{12} \cos\theta$ where $M_p$=mass of the paper stack. $\theta$=angle of the tray, $u_{12}$=coefficient of friction between sheets 1 and 2. The solution to this equation as found by Den Hartog, Trans. A.S.M.E., Vol. 53, 1931, is:

$$x_o = -G\frac{F}{k} + \frac{P}{k}\sqrt{\frac{1}{q^2} - H^2\left(\frac{F}{P}\right)^2}$$

where:

$$G = \frac{\sinh(\beta\pi C) - \sqrt{\frac{C}{1-C^2}}\cdot\sin\beta\pi\sqrt{1-C^2}}{\cosh(\beta\pi C) + \cos\beta\pi\sqrt{1-C^2}}$$

$$H = \frac{\beta}{\sqrt{1-C^2}}\cdot\frac{\sin\beta\pi\sqrt{1-C^2}}{\cosh(\beta\pi C) + \cos\beta\pi\sqrt{1-C^2}}$$

-continued $$q = \left(\frac{1}{V^2} + \left(\frac{2}{\beta}C\right)^2\right)^{\frac{1}{2}}$$

$$V = \frac{\beta^2}{1-\beta^2},\ \beta = \frac{\omega_N}{\omega},\ C = \frac{c}{c_c}$$

where $\omega_N$=natural frequency of the tray and $c_c$=critical viscous damping coefficient. At resonance, $\beta=1$ and if $c/c_c << 1$, G and H simplify to $$G \simeq \frac{2}{\pi c},\ H \simeq \frac{1}{\pi}$$

giving $$x_o = -\frac{2}{\pi C}\cdot\frac{F}{k} + \frac{P}{k}\cdot\frac{1}{2C}$$

Rearranging the above, the frictional force $F=M_p g u_{12}\cos\theta$ is given by $$F = \frac{\pi}{4}P - x_o k\frac{\pi}{2}C \quad (2)$$

where

C=damping term
k=spring compliance
$x_o$=amplitude of tray motion

The last equation shows that the frictional force can be found from the driving force and the peak amplitude of the motion. If the vibration amplitude is kept constant, the frictional force is a function of the driving force alone, i.e.

$$F = \frac{\pi}{4}P - A,$$

where A=constant.

In one embodiment, the natural resonant frequency of the system was 23 Hertz. In addition to estimating the combined spring constant, k, from the mass of the tray and the resonant frequency, the combined spring constant was also found from static deflection measurements. The viscous damping constant, C, was found both from the line width of the unloaded tray resonance and from the magnification of the vibrational amplitude at resonance.

Figure 4:
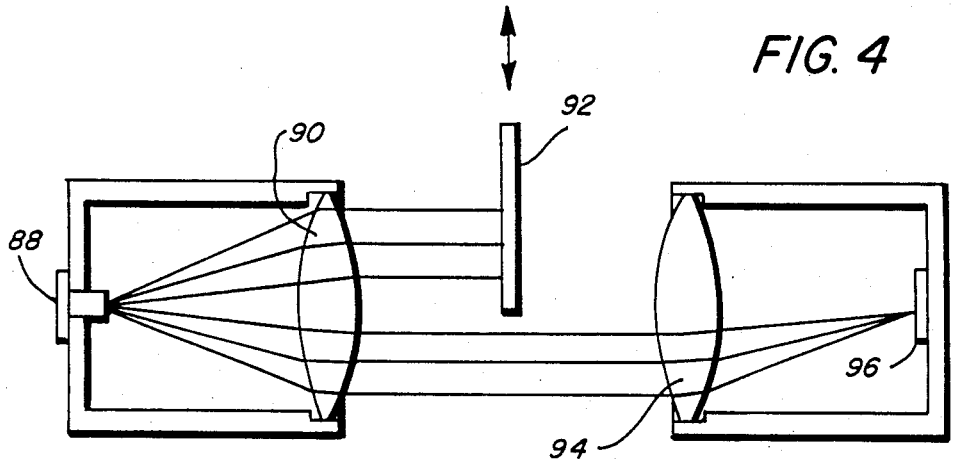
FIG. 4 is a schematic of the motion sensor illustrated in FIG. 2.
Figure 5:
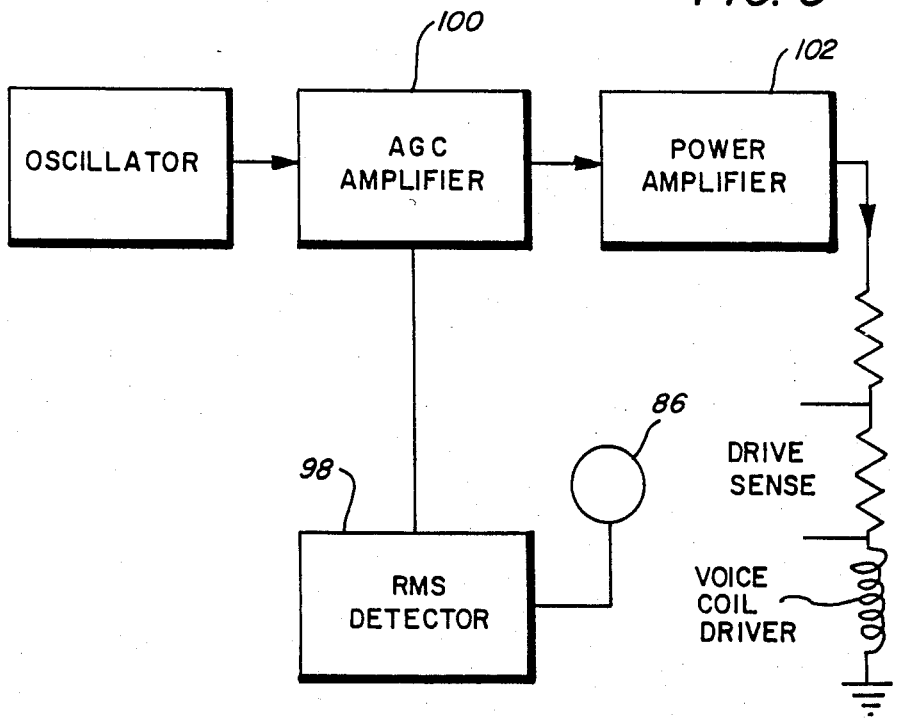
FIG. 5 illustrates the automatic gain control for use in the present invention.

The mechanical damping of the tray can increase by several orders of magnitude in going from the unloaded tray to the heavily loaded tray at zero air knife pressure. Some form of amplitude control is necessary since the measurement of the frictional force is simplified if the vibration amplitude is held approximately constant. With reference to FIG. 5, there is shown an automatic gain control system for maintaining constant amplitude. With reference to FIGS. 2 and 4, there is illustrated the motion sensor 86 comprising an infrared LED 88, a collimating lens 90, a knife edge 92, a focusing lens 94 and an optical detector 96. The knife edge interrupts the light flux falling on the detector causing a change in the detector output which is proportional to the amplitude of motion. The output from the motion sensor 86 is rectified in the RMS detector 98. The smoothed DC output from the RMS detector 98 controls the gain of the AGC amplifier 100 which controls the drive to the power amplifier 102. F can be estimated from the reflected impedance of the electromechanical driver or in the present embodiment, F may be found from the current to the driving coil obtained by monitoring the voltage across a low resistance.

Figure 6:
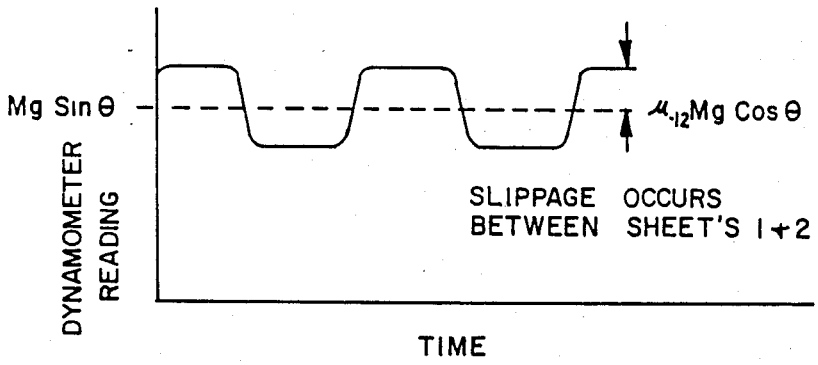
FIG. 6 illustrates the periodic force exerted on a dynamometer in another embodiment of the present invention.

In another embodiment, the back stop 84 was replaced by a dynamometer with the periodic force exerted on the dynamometer illustrated in FIG. 6. When $u_{12} < \tan\theta$, during the parts of the cycle when slippage occurs between sheets 1 and 2, the force measured by the dynamometer will be $$F_D = Mg \sin\theta \pm u_{12} Mg \cos\theta.$$

The mass of the stack (and stack height if the paper size and density are known) may be estimated from the time average value of $F_D$ and equals $$M = \frac{\overline{F_D}}{g \sin\Theta}$$

The coefficient of friction $u_{12}$ may now be found from the variation in $F_D$ and is $$u_{12} = \frac{F_{Dmax} - F_{Dmin}}{2\,\mathrm{Mg}\cos\Theta} = \frac{F_{Dmax} - F_{Dmin}}{2\,\overline{F_D}} \cdot \tan\Theta$$

Note that in this case it is not necessary to know either the mass of paper (or stack height) or the amplitude of the driving force before $u_{12}$ can be estimated.

Figure 7:
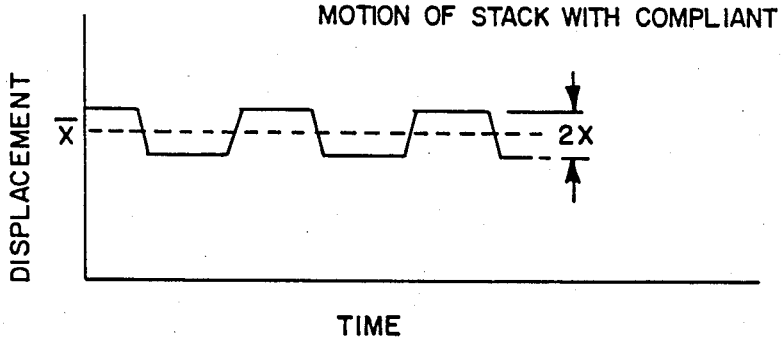
FIG. 7 illustrates periodic motion with a compliant backstop.

If the fixed back stop is replaced by a compliant back stop with a spring constant k, for $u_{12} < \tan\theta$, and neglecting inertial effects, $u_{12}$ may be found from the amplitude of the motion of the stack as measured by the stack motion sensor. The motion waveform, when slippage between sheets 1 and 2 occurs, is shown in FIG. 7. The displacement is given by $$x \pm \Delta x = \frac{1}{k}\{Mg\sin\theta \pm u_{12}\, Mg\cos\theta\}$$

where $x \pm \Delta x$ is the observed displacement of the stack. Again, the mass of the paper stack may be found from the time average of x and is $$M = \frac{\bar{x}k}{g\sin\theta}$$

which gives $$u_{12} = \frac{\Delta x}{x} \cdot \tan\theta$$

Again, note that the measurement is independent of both the mass of the stack and driving force, (provided the driving force is $> u_{12}$ Mg cos $\theta$) and also of the spring constant k. Finally, it should be noted that $u_{12}$ could be found from the fraction of the driving cycle during which slippage between sheets 1 and 2 occurs.

If the back stop is fixed, a single point value of $u_{12}$ may be obtained by noting when stack motion ceases. This point occurs when $$u_{12} \leqq \tan\theta$$

and is theoretically the maximum value $u_{12}$ can have for no misfeeds to occur, (neglecting inertial effects).

The methods of estimating $u_{12}$ described above can all be adapted to step or single pulse motion of the vacuum transport. There are two reasons for considering step or single pulsed motion of the transport. First, a single measurement may be made during a precisely defined period, as would be required during a feed cycle. The second reasons is that this kind of motion would be particularly suitable when considering the sliding vacuum transport.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

What is claimed is:

1. In a vacuum corrugation sheet feeder system having an air knife to provide air pressure to separate a bottom sheet from the remainder of the sheets in the stack in a sheet feeder tray, the method of controlling the air pressure comprising the steps of:

driving the sheet feeder tray at resonant frequency, increasing the air knife pressue from a point where the sheet stack moves with the tray to the point where the sheet stack remains stationary, estimating the weight of the stack, estimating the frictional force to maintain a given vibrational amplitude, determining the coefficient of friction between the bottom two sheets of the stack, and controlling the amount of air pressure from the air knife until a predetermined coefficient of friction is achieved.

2. A method for controlling the operation of an automatic document handler having air flotation means associated with the document separator-feeder mechanism of the document handler to increase the document handling ability of the feeder comprising the steps of:

driving the tray holding the documents at a given frequency, directing the air from the air flotation means between the bottom two documents in the tray, determining the coefficient of friction between said two documents, and adjusting the quantity of air discharged from said air flotation means until a predetermined coefficient of friction is achieved.

3. A method according to claim 2 wherein the step of adjusting the quantity of air discharged from the air flotation means is accomplished by bleeding air from the air flotation means when less air is required thereby.

4. In a sheet feeder system having an air knife to provide air pressure to separate a bottom sheet from the remainder of the sheets in the stack in a sheet feeder tray, the method of controlling the air pressure comprising the steps of:

vibrating the sheet feeder tray, increasing the air knife pressure from a point where the sheet stack moves with the tray to a point of reduced sheet stack movement, determining the frictional relationship between the bottom two sheets of the stack, and controlling the amount of air pressure from the air knife until a predetermined frictional relationship is achieved.

5. The method of claim 4 including the step of estimating the weight of the stack.

6. The method of claim 5 including the step of estimating the frictional force to maintain a given vibrational amplitude.

7. The method of claim 4 wherein the feeder tray is mounted on a spring and including the step of driving the tray by a voice coil.

8. The method of claim 4 including the step of vibrating the tray at resonant frequency.

9. The method of claim 4 including the step of increasing the air knife pressure to the point where the sheet stack remains stationary.

10. A bottom sheet separator-feeder for separating and forwarding sheets seriatim comprising:

a tray adapted for supporting stack of sheets, vacuum sheet feed means associated with said tray located in a position spaced from the bottom sheet in the stack, air injection means adapted to provide a layer of air between said tray and the bottom sheet in the stack and between the bottom sheet and the remainder of the sheets in the stack, means to determine the coefficient of friction between the bottom sheet of the stack and the remainder of sheets in the stack, and means to control the amount of air pressure to achieve a given coefficient of friction.

11. A bottom sheet separator-feeder for separating and forwarding sheets seriatim comprising:

a tray adapted for supporting a stack of sheets, frictional feed means comprising a plurality of feed belts spaced below the supported position of the planar surface of the bottom sheet in the stack, means forming a vacuum plenum associated with said feed means, means for lowering the air pressure in said plenum causing the bottom sheet in the stack to be drawn into contact with and acquired by said feed means, forming a corrugation in said sheet and for separation and forwarding of the bottom sheet from said stack;

air knife means to direct an air flow against the lead edge of the bottom sheet acquired from the remainder of the sheets in the stack, and means for controlling the amount of air pressure from the air knife to achieve a given coefficient of friction between the bottom sheet and the remainder of the stack.

12. A sheet separator according to claim 11 in which the means for controlling the amount of air pressure includes a motion sensor comprising an LED, a collimating lens, a focusing lens, a knife edge and a photodiode detector.

13. A sheet separator according to claim 11 in which the means for controlling the amount of air pressure includes a fixed backstop, the stack tray resting against said backstop.

14. The separator according to claim 13 wherein the tray is mounted on a spring and is driven by a voice coil.

15. The separator according to claim 14 wherein the resonant frequency of the spring is 23 Hertz.

16. The separator according to claim 11 including the means to drive the tray at resonant frequency and the means to control the vibration amplitude of the tray.

17. The separator according to claim 11 wherein the means for controlling includes an automatic gain control amplifier.

18. A bottom sheet separator-feeder for separating and forwarding sheets seriatim comprising:

a stack tray adapted for supporting a stack of sheets, frictional feed means comprising a plurality of feed belts spaced below the supported position of the planar surface of the bottom sheet in the stack, means forming a vacuum plenum associated with said feed means, said vacuum plenum having openings therein facing the bottom sheet in the stack, and having a raised portion therein underlying at least one of said belts to raise at least one of said belts above the plane of the top surface of the remainder of said belts, means for lowering the air pressure in said plenum below atmospheric pressure causing the bottom sheet in the stack to be drawn into contact with and acquired by said feed means, said feed belts thereby forming a corrugation in said sheet by said raised belts for separation and forwarding of the bottom sheet from said stack;

air knife means to direct an air flow against the lead edge of the acquired bottom sheet from the remainder of the sheets in the stack and reduce drag forces between the bottom sheet and the bottom of the remainder of the stack, and means for controlling the amount of air pressure from the air knife to achieve a given coefficient of friction between the bottom sheet and the remainder of the stack.

* * * * *